US009284764B2

(12) United States Patent
Hudson et al.

(10) Patent No.: US 9,284,764 B2
(45) Date of Patent: Mar. 15, 2016

(54) SLIDING PIN LOCK MECHANISM FOR OVERHEAD DOOR WITH MICROSWITCH

(71) Applicants: Dale R. Hudson, Jamesville, NY (US); Jay Tillman, Southbury, CT (US)

(72) Inventors: Dale R. Hudson, Jamesville, NY (US); Jay Tillman, Southbury, CT (US)

(73) Assignee: Jamas Enterprises LLC, Syracuse, NY (US)

( * ) Notice: Subject to any disclaimer, the term of this patent is extended or adjusted under 35 U.S.C. 154(b) by 271 days.

(21) Appl. No.: 14/018,471

(22) Filed: Sep. 5, 2013

(65) Prior Publication Data

US 2015/0061300 A1 Mar. 5, 2015

Related U.S. Application Data

(63) Continuation-in-part of application No. 13/600,838, filed on Aug. 31, 2012, now Pat. No. 9,187,931.

(60) Provisional application No. 61/530,098, filed on Sep. 1, 2011.

(51) Int. Cl.

| | |
|---|---|
| ***E05C 1/12*** | (2006.01) |
| ***E05D 15/16*** | (2006.01) |
| ***E05F 15/18*** | (2006.01) |
| ***E05B 17/20*** | (2006.01) |
| ***E05B 65/00*** | (2006.01) |
| ***E05B 67/38*** | (2006.01) |
| ***E05C 1/04*** | (2006.01) |
| *E05B 47/00* | (2006.01) |

(52) U.S. Cl.

CPC ..... *E05D 15/16* (2013.01); *E05B 17/2073* (2013.01); *E05B 65/0021* (2013.01); *E05B 67/383* (2013.01); *E05C 1/04* (2013.01); *E05F 15/18* (2013.01); *E05B 2047/0069* (2013.01); *Y10T 70/491* (2015.04); *Y10T 292/097* (2015.04)

(58) Field of Classification Search

USPC ..... 292/164, 163, 166, 169

See application file for complete search history.

(56) References Cited

U.S. PATENT DOCUMENTS

| | | | | |
|---|---|---|---|---|
| 2,784,023 | A * | 3/1957 | Pisani | 292/341.15 |
| 3,929,360 | A * | 12/1975 | Gulistan | 292/67 |
| 4,658,106 | A | 4/1987 | Makoe | |
| 5,546,777 | A * | 8/1996 | Liu et al. | 70/257 |
| 6,925,785 | B1 * | 8/2005 | Kawasaki | 54/37.1 |

* cited by examiner

*Primary Examiner* — Mark Williams

(74) *Attorney, Agent, or Firm* — Bernhard Molldrem, Jr.

(57) ABSTRACT

A door lock mechanism for an overhead door employs a sliding pin or rod that passes into the path of the rollers in the track, and obstructs the roller from movement in the direction to open the door. A spring in the door lock frame biases the sliding pin towards a proximal open position. The sliding pin has a swing arm that extends radially from the pin's proximal end, and which engages retaining structure at the proximal end of the door lock frame. In the lock position the distal end of the sliding pin blocks movement of wheels or rollers in the vertical track. The arm is rotated out of engagement with the retaining structure to release the pin so it may slide proximally to an unlocked position. A microswitch in the interior of the lock switches on when the sliding pin is moved to the locked position and turns off when the pin is returned to its unlocked position. A sleeve disposed over the proximal part of the spring engages the actuator of the microswitch.

14 Claims, 4 Drawing Sheets

SLIDING PIN LOCK MECHANISM FOR OVERHEAD DOOR WITH MICROSWITCH

This application is a continuation-in-part of our earlier U.S. patent application Ser. No. 13/600,838, filed Aug. 31, 2012, and which claims priority under 35 U.S.C. 119(e) of Provisional Patent Appln. Ser. No. 61/530,098, filed Sep. 1, 2011.

BACKGROUND OF THE INVENTION

This invention relates to locking mechanisms for use with an overhead door, in particular with the type of overhead door on which supporting rollers move up or down in a vertical track or rail. The locking mechanism provides a bar or rod that passes into the path of the rollers in the track, and obstructs the roller from movement in the direction to open the door. The locking mechanism is a straightforward mechanical item with a frame, bar, spring, and a place to secure a padlock to hold the mechanism in its locked position. A microswitch contained within the housing changes state (from open or OFF to closed or ON) when the locking mechanism is moved to the locked position. The microswitch can be used to indicate the locked/unlocked status of the overhead door, and may also be used as an interlock, e.g., to prevent a hydraulic dock leveler from actuating when the door is closed and locked, or to keep a dock light from turning on, which might heat a spot on the door and cause heat damage.

To date, overhead door locks of this kind have been made of a sheet steel bent into a box shape which is mounted onto the door, with a bar that slides through slots in the box, and which enters a slot cut in the track or rail. These devices are prone to bending and deforming, and are often damaged after a period of normal use in an industrial or warehouse environment. Consequently, there is a need for frequent replacement. Also, the security afforded by these conventional overhead door locks is quite limited.

An example of a lock for an overhead door is described in Shoemaker U.S. Pat. No. 6,027,148 in which a fixed component mounted onto the frame of the overhead door, i.e., somewhere along the track, captures a rod that is mounted somewhere on the movable overhead door, entering an opening in a rotary element that turns and is retained in a detent. This is a fairly complex apparatus, with numerous moving parts which can be easily knocked out of alignment.

Another example of a lock for an overhead door is described in Shoemaker Patent Application Publication Pub. No. 2003/0188489, in which a rocking member, e.g., a cam, is disposed in a trackway of the overhead door, allowing the door to close but blocking a track wheel to prevent opening until the cam is moved out of the way. This device automatically moves the cam to the closed position, and a solenoid needs to be actuated to release the cam to permit the overhead door to open.

OBJECTS AND SUMMARY OF THE INVENTION

Accordingly, it is an object of the present invention to provide an overhead door lock mechanism, with a microswitch or an equivalent electrical switch, that avoids the drawbacks of the prior art.

It is another object to provide an overhead door lock mechanism and microswitch or other switch device that is robust and reliable, and which will sustain, without damage, forces and shocks expected in normal use, and achieve an increase in use lifetime and in the level of security afforded.

It is a more specific object to provide an overhead door lock that mounts directly onto the vertical rails or tracks, rather than on the door, and in which the microswitch device closes only when the door is closed and the lock mechanism is slid into its locked position.

In accordance with one aspect of the present invention, in the track-mounted overhead door lock mechanism, a round rod or dowel moves, i.e., slides, through a hole in the track or rail to block travel of the roller up the track. The device has a frame in which there is a mounting block that is affixed onto the track using standard overhead door fastening hardware, a plate that extends proximally, i.e., out laterally away from the overhead door rail, and a second block or plate spaced proximally from the mounting block. There are aligned circular openings in the second block and in the mounting block, and the sliding pin or dowel passes through these openings. A coil spring is positioned over the pin or dowel between the mounting block and a retaining pin or retaining ring on the sliding pin, urging the latter towards its open or unlock position. A corresponding opening is formed or drilled in the track to allow the pin to penetrate and block the travel of the rollers when in the locked position. Alternatively, the pin can slide into a receiver plate or receiver housing mounted on a door panel.

A swing arm extends radially from the proximal end of the pin, and this is rotatable into or out of alignment with a retaining plate or a retaining slot. The retaining plate or slot holds the arm and the sliding pin in place in the locked position; if the swing arm is rotated out of engagement, the spring urges the pin out to its unlocked or open position. Some means is provided for insertion of a padlock or other key or combination lock to prevent the swing arm from being rotated to the unlock position; this can be an opening in the retaining plate, in the radial arm of the pin, or in both.

Favorably, the pin or dowel may be formed of a hard, rigid steel, such as a tool steel of the type used in drills. Mounting holes may be formed in the distal or mounting block for accepting mounting screws or bolts to attach the locking device to the track or rail.

In embodiments of this invention, a microswitch is mounted within the frame of the lock. This microswitch has a switch arm, lever, or equivalent actuator that which is movable between a first position in which the microswitch is in an ON or OFF state and a second position in which the microswitch is in the other state. A cooperating switch actuating member is affixed, directly or indirectly, onto the sliding pin, and configured so as to engage the switch arm to move it to its second position when the pin slides distally to its locked portion, and so as to move out of engagement when the pin returns proximally to its unlocked position to permit the switch arm to return to its first position. Typically, the microswitch is normally OFF, i.e., when the lock mechanism is unlocked and the overhead door is opened or may be opened) and is turned ON when the lock mechanism is closed or locked.

The microswitch can be used as a positive interlock to ensure, for example, that a dock leveler is not operative when the overhead door is closed and locked, so that inadvertent attempts to actuate the dock leveler when the door is locked in its lowered position will not damage the overhead door. Also, the microswitch may be used with a dock light, so that it can only be turned on when the overhead door is unlocked and opened, as the heat from the dock light may damage the overhead door if the door is closed. Importantly, this arrangement can provide a positive indication that the overhead door is locked, helping to address security concerns and safety concerns.

The switch actuating member can take the form of a sleeve member disposed over a proximal portion of sliding pin member. In favorable embodiments of the lock mechanism, the spring is a coil spring coaxially disposed over the sliding pin with one end seated against the distal mounting portion of the frame of the lock, and with its other end seated against a retaining member, e.g., a cross pin, that is affixed onto the aid sliding pin. In that case, the tubular member may be in the form of a hollow cylinder disposed over the coil spring.

The above and many other objects, features, and advantages of this invention will be more fully appreciated from the ensuing description of a preferred embodiment, which is to be read in conjunction with the accompanying Drawing.

DETAILED DESCRIPTION OF THE PREFERRED EMBODIMENT

Figure 1:
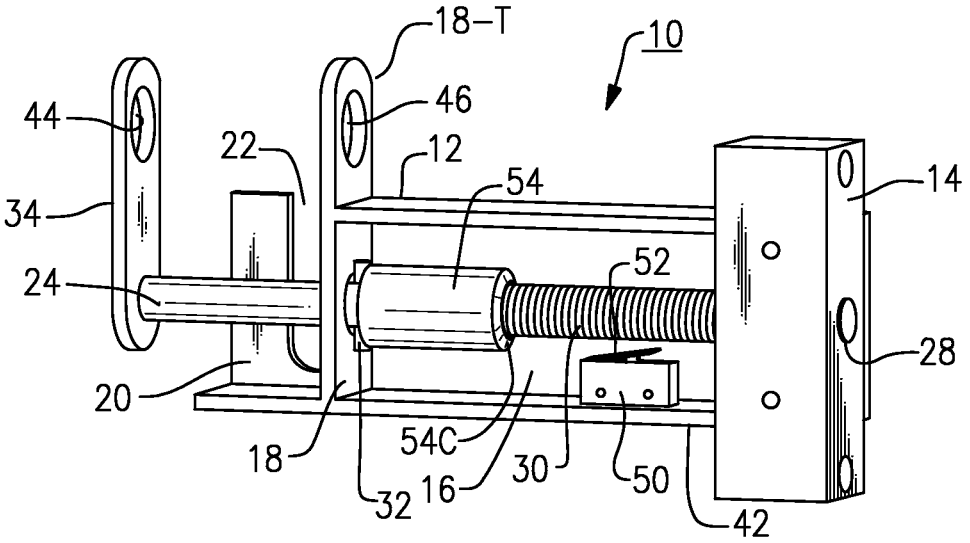
FIG. 1 is a rear perspective view of an overhead door lock according to one embodiment of this invention, shown in the open or unlocked (released) position.
Figure 2:
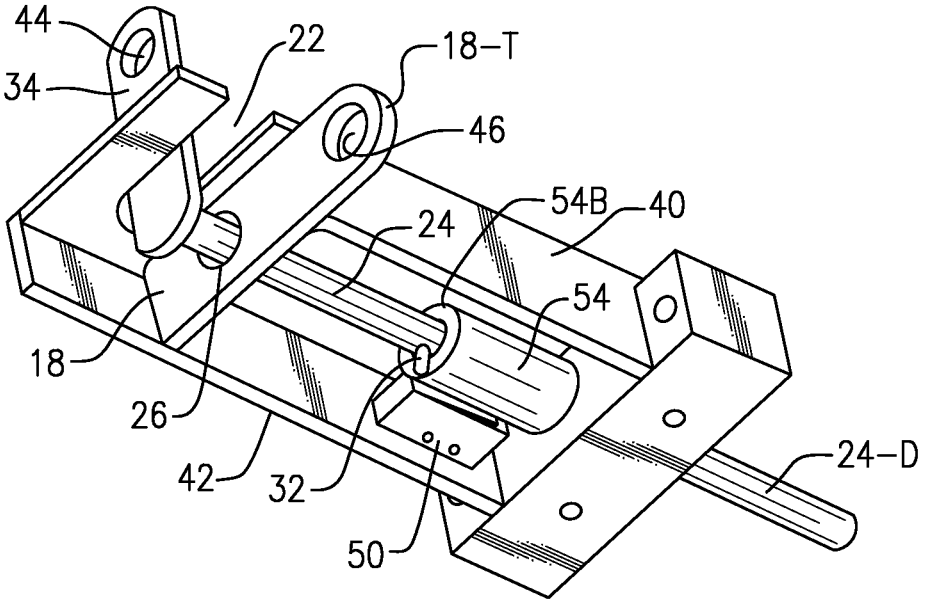
FIG. 2 is a perspective view thereof, shown in the extended or locked position.
Figure 3:
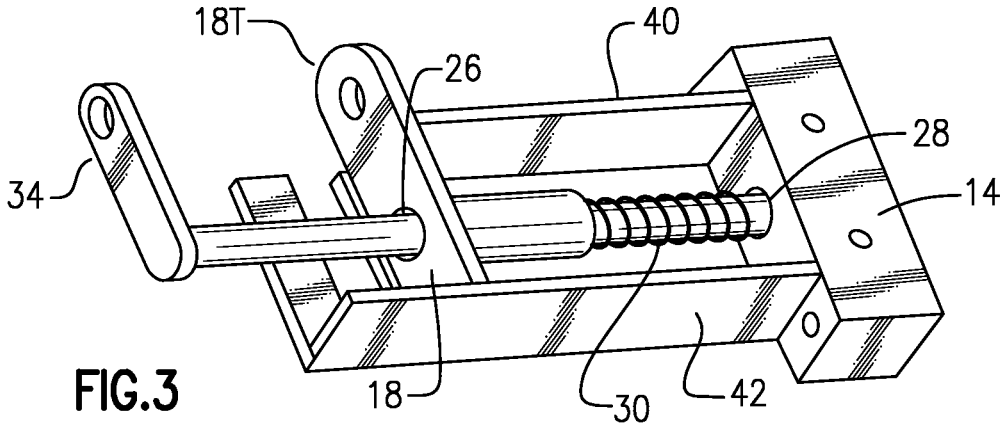
FIG. 3 is another rear perspective thereof in the open or unlocked positions, respectively.
Figure 4:
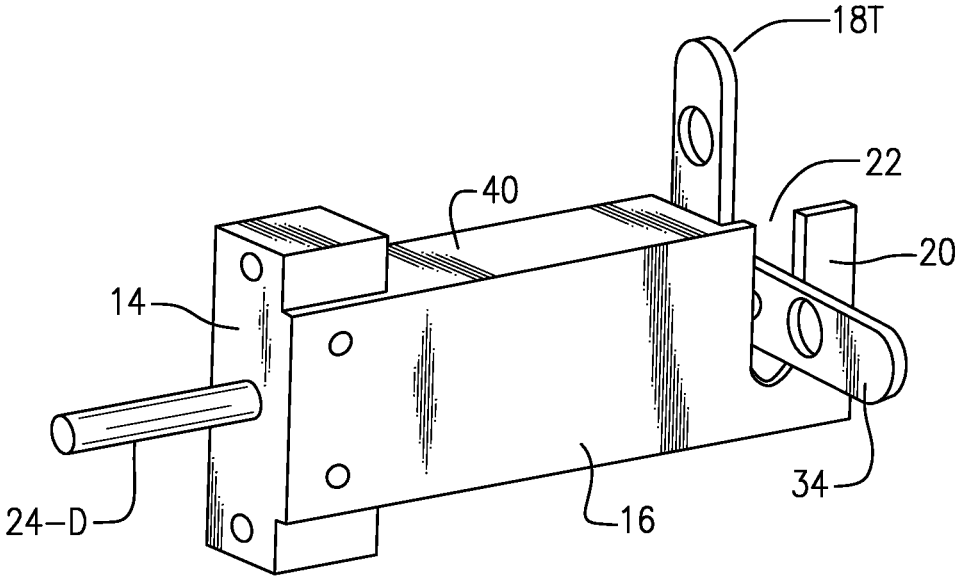
FIG. 4 is a front perspective view thereof.

With reference now to the Drawing, and initially to FIGS. 1 to 4, a sliding-pin lock mechanism 10 according to one embodiment has a frame 12 that comprises a vertical mounting block 14 that can be bolted to a vertical rail, as discussed later. Upper and lower openings (un-numbered) accommodate mounting bolts or screws for that purpose. A transverse front steel plate 16 extends to proximal, i.e., laterally away from the mounting block 14 (and associated rail). A second or proximal block or end plate 18 is spaced apart from the block 14. A portion of the front plate 16 extends proximally past the end plate 18 and serves as a retaining plate member 20, with a gap 22 defined between the plate member 20 and the end plate 18 to accommodate a swing arm or swing plate 34 on the sliding pin 24, as will be discussed shortly. As seen also in FIGS. 2 to 4, a round profile sliding rod, dowel or pin 24 extends laterally through the frame 12 through aligned round guide passages 26 and 28 in the mounting block 14 and second block 18, respectively. As shown in FIGS. 2 and 3, a coil spring 30 is positioned over the pin 24 between the mounting block 14 and a retaining device, here a retaining cross-pin 32 that is affixed onto the sliding pin 24 between the block 14 and the plate 18. This cross-pin 32 limits the travel of the pin 24 in the proximal direction.

The frame also has an upper plate 40 and lower plate 42, which together with the front plate 16, proximal end plate 18 and distal block 14, defines an enclosure. Here the back of the enclosure is open, e.g., as viewed in FIGS. 1 and 2. This open side normally faces the building wall alongside the rail of the overhead door, as the device is typically installed on the overhead door guide rails.

At the proximal end of the pin 24 there is a radial swing arm or plate 34, i.e., situated perpendicular to the axis of the sliding pin 24. This swing arm 34 engages the slot or gap 22 between the plate 18 and the retaining plate 20 to hold the sliding pin 24 in its extended or locked position, as shown in FIG. 2. In this position, a distal portion 24-D of the sliding pin 24 extends out beyond the plate 14 to engage a portion of the overhead door, as will be explained shortly, to keep it from being lifted open. The swing arm 34 on the sliding pin 24 can be rotated by hand out of engagement with the retaining plate 20 to allow the spring 30 to return the sliding pin 24 proximally, to the unlocked position. An opening 44 in the swing arm 34 is adapted to accommodate the shackle of a padlock or similar device to secure the lock mechanism in the closed or locked position. Here, an upper portion of the plate 18 extends upward as a tab 18-T which has its own padlock opening 46.

There are many variations possible for this type of sliding-pin door lock, and many of these are discussed in our earlier U.S. patent application Ser. No. 13/600,838, filed Aug. 30, 2012, and the disclosure of which is incorporated herein by reference.

Inside the enclosure, and in this embodiment mounted on the lower plate 42, is a microswitch 50. This is placed towards the distal side of the enclosure space within the frame. The microswitch is a normally-open momentary contact switch with an actuator arm 52 that turns the switch on when it is depressed, and turns the switch off when it is released. Favorably, the microswitch has a solid rectangular body that encloses and protects switch parts within. The leads or wires to the microswitch are not shown here, but these may extend to a safety light, or to an interlock, e.g., for a dock leveler system or for a dock light. In some embodiments, the microswitch could be a normally-closed switch, depending on the application.

A cylindrical sleeve 54 is shown here disposed over the proximal portion of the sliding pin 24 and abutting the cross-pin 32. Favorably the sleeve 54 may be affixed to the cross-pin, so that it travels with the sliding pin when the latter is moved between its unlocked and locked positions. The sleeve has an inside diameter sufficient so that the coil spring 30 fits within the annulus that exists between the sleeve 54 and the pin 24. When the pin 24 is pushed in (distally) to the locked position, as shown in FIG. 2, the sleeve 54 encounters the actuator arm 52 of the microswitch, and turns the latter on. When the pin 24 is allowed to retract out to the unlocked position, as in FIG. 1, the sleeve 54 loses mechanical contact with the actuator arm 52, and the microswitch 50 turns off.

Figure 5:
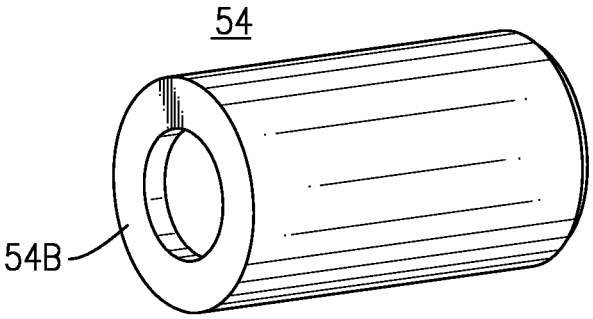
FIGS. 5 and 6 are perspective views of the sleeve that triggers the microswitch incorporate into the overhead door lock of this embodiment.
Figure 6:
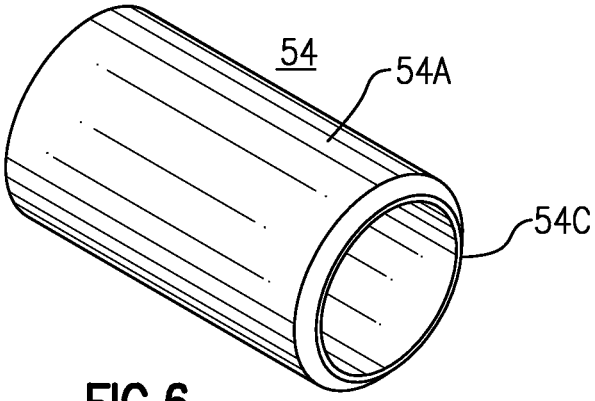
Figure 7:
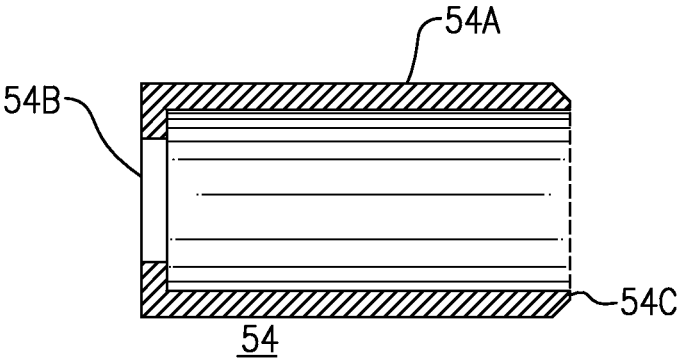
FIG. 7 is a cross-section thereof.

As shown in FIGS. 5, 6, and 7, the sleeve 54 in this embodiment has a generally cylindrical body 54A, with a shoulder flange 54B at the proximal end, which serves to capture the proximal end of the spring 30, and which also rests against the cross-pin 32. At the distal end is a tapered or conic surface 54C that facilitates engagement with the actuator arm 52 of the microswitch 50. In this embodiment the sleeve 54 is metal, but in other embodiments a tough synthetic plastic could be used.

Alternatively, the sleeve 54 may be of ferromagnetic material, with the microswitch being magnetically actuated when the sleeve is in proximity to it.

Figure 8:
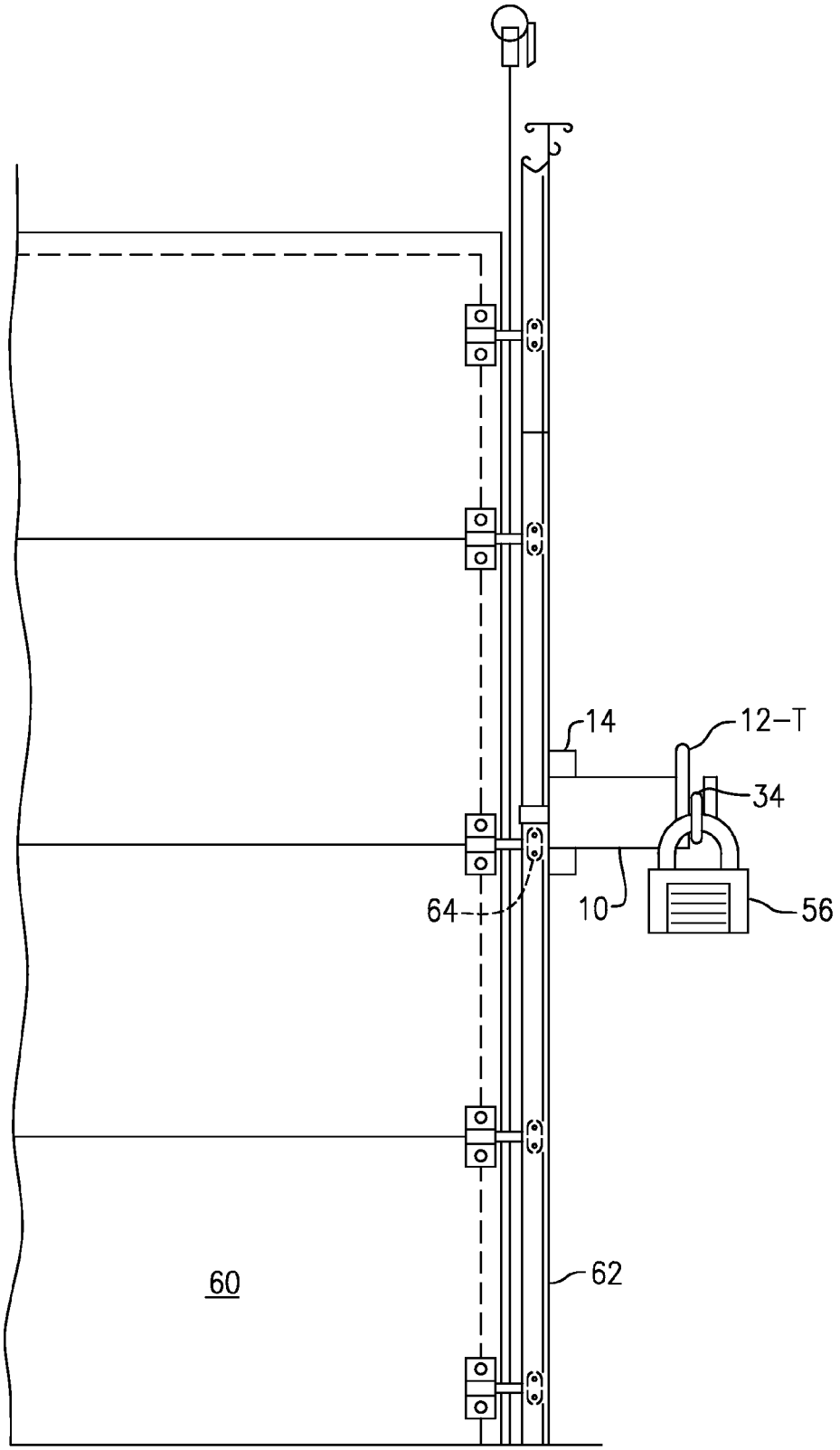
FIG. 8 is an environmental view of the overhead door, vertical track or rail, and lock mechanism of this embodiment.

FIG. 8 shows the arrangement of the locking device 10 of this embodiment in connection with a vertically-openable overhead door 60 with steel tracks or rails 62 that accommodate the wheels or rollers 64 of the door. The door locking device 10 can exist in either a right-side or a left-side version, for mounting on either the right or the left vertical rail. The locking device 10 can be readily mounted directly onto the vertical track 62, by drilling suitable openings in the track to accommodate bolts or other mounting hardware and an opening for the passage of the locking pin 24. The position for mounting is selected so that the wheel or roller 64 will be biased upwardly against the pin 24 by action of the door seal bead when the door 60 is closed and the lock 10 is engaged or locked.

Here, the locking device 10 on the door rail 62, is illustrated as being secured in the locked position with a padlock 66. The shackle of the padlock 62 passes through the opening 44 in the swing arm 34 and prevents the swing arm from being lifted out of the gap 22, so the sliding pin 24 cannot be moved to the unlocked position until the padlock is removed.

The embodiments shown and described here illustrate the main principles of the invention, but many other applications and arrangements are possible. The shape and dimensions of the frame, the shape of the swing arm, and the size and materials used for the sliding pin can be varied depending on engineering and design choices. The sliding pin 24 does not have to have a round shaft. In place of the coil spring 30, other resilient springs could be used. While the invention has been described with reference only to one specific preferred embodiment, the invention is certainly not limited to that embodiment. Rather, many modifications and variations will become apparent to persons of skill in the art without departure from the scope and spirit of this invention.

We claim:

1. A locking mechanism that has a proximal end and a distal end that is adapted to attach to a flat outer web of the vertical track of an overhead door to hold the door locked in its lowered or closed position, the overhead door having a plurality of rollers that travel vertically within the vertical track, the mechanism comprising:

a frame, including a distal mounting portion that is adapted to be affixed onto the flat outer web of said vertical track, the frame extending proximally away from the flat outer web of the vertical track;

a sliding pin that passes in a proximal-distal direction through an opening in the distal mounting portion of the frame, and is configured to penetrate the flat outer web portion of said vertical track so as to block travel of the rollers when the pin is extended distally into the track, with said sliding pin having an arm affixed onto and extending radially, in respect to the axis of said sliding pin or dowel, from a proximal end of said sliding pin, the sliding pin being free to rotate at least a limited amount when said arm is moved;

a spring contained within said frame and urging said sliding pin in a proximal direction away from said vertical track;

retaining structure at a proximal end of said frame for engaging said radial arm when the sliding pin is slid distally toward said vertical track to a locked position, and the radial arm being capable of being rotated out of engagement with said retaining structure to permit the pin to slide proximally to an unlocked position wherein the spring urges the sliding pin away from and out of contact with the rollers in said vertical track;

an electrical microswitch mounted within said frame, and having a switch actuator thereon which is movable between a first condition in which the microswitch is in one of an ON state and an OFF state and a second condition in which the microswitch is in the other of said states; and a switch actuating member affixed onto a portion of said sliding pin and engaging said switch actuator to urge the latter to its second condition when the sliding pin is slid distally to its locked portion to lock said overhead door, and which moves out of engagement with said switch actuator when the sliding pin is slid proximally from its locked position, the moving of the arm out of engagement with the engaging structure and proximal motion of said sliding pin serving to permit the switch actuator to return to its first position.

2. The lock mechanism of claim 1 wherein said switch actuating member includes a sleeve member disposed over a portion of said sliding pin member and adapted to slide into engagement with said switch actuator when said sliding pin moves distally to its locked position.

3. The lock mechanism of claim 2 wherein said spring includes a coil spring coaxially disposed over said sliding pin and having a distal end seated against said distal mounting portion and a proximal end seated against a retaining member that is affixed onto said sliding pin, and wherein said sleeve member is in the form of a hollow cylinder disposed over the proximal end of said coil spring.

4. The lock mechanism of claim 3 wherein a proximal end of said sleeve is in the form of a tubular member that has a shoulder flange capturing said proximal end of said coil spring.

5. The lock mechanism of claim 3 wherein said tubular member has a conic surface at a distal end thereof.

6. The lock mechanism of claim 1 wherein said distal mounting portion includes a mounting block having a central aperture therein to serve as said opening for the sliding pin, and having first and second mounting openings disposed above and below the central aperture, respectively, and each of the first and second mounting openings being adapted to receive mounting screws therein.

7. The lock mechanism of claim 1 wherein said retaining structure includes a proximal block member having a proximal pin opening therein aligned with the opening in the distal mounting portion.

8. The lock mechanism of claim 7 wherein said retaining structure includes a retaining plate offset proximally from said proximal block and adapted to block proximal motion of the arm of said sliding pin.

9. The lock mechanism of claim 8 wherein said retaining plate includes an aperture therethrough adapted to receive the shackle of a padlock.

10. The lock mechanism of claim 1 wherein the arm of said sliding pin is in the form of a flat plate affixed onto a proximal end of said sliding pin, and having an opening therethrough adapted to receive the shackle of a padlock.

11. The lock mechanism of claim 10 wherein the frame includes a proximal plate through which said sliding pin passes, the proximal plate having a tab portion extending above an upper edge of the frame, and having a padlock opening therein.

12. The lock mechanism of claim 1 wherein said electrical switch includes a microswitch having a generally rectangular solid body and mounted on a surface of said frame.

13. The lock mechanism of claim 12 wherein the switch actuator of said microswitch includes a switch arm normally in a first position when out of engagement with said switch actuating member but which moves to a second position when the switch actuating member moves out of engagement with it.

14. The lock mechanism of claim 1 wherein the microswitch is a magnetically actuated switch, and the switch actuating member is formed of a ferromagnetic material, such that the microswitch is magnetically actuated when the sleeve member is in proximity of the microswitch.

* * * * *